US006468045B1

(12) United States Patent
Yun

(10) Patent No.: US 6,468,045 B1
(45) Date of Patent: Oct. 22, 2002

(54) ROTARY PISTON PUMP

(76) Inventor: Xiaoying Yun, Fl. 2, Entrance 3, Bldg. 3, the Dormitory of Municipal Committee, Zhongshan Xi Road, Hubbot City 010020 (CN)

( * ) Notice: Subject to any disclaimer, the term of this patent is extended or adjusted under 35 U.S.C. 154(b) by 0 days.

(21) Appl. No.: 09/674,958

(22) PCT Filed: May 5, 1999

(86) PCT No.: PCT/CN99/00064

§ 371 (c)(1),
(2), (4) Date: Jan. 5, 2001

(87) PCT Pub. No.: WO99/58855

PCT Pub. Date: Nov. 18, 1999

(30) Foreign Application Priority Data

May 8, 1998 (CN) ..... 98101782 A

(51) Int. Cl.[7] ..... F04B 1/06
(52) U.S. Cl. ..... 417/221; 418/63; 418/243
(58) Field of Search ..... 417/221; 418/57, 418/61, 63, 66, 243, 248, 250, 62

(56) References Cited

U.S. PATENT DOCUMENTS

| | | | | | |
|---|---|---|---|---|---|
| 116,293 | A | * | 6/1871 | Freeman | 418/248 |
| 826,453 | A | * | 7/1906 | Thormahlen | 418/250 |
| 1,006,093 | A | * | 10/1911 | Holt | 418/250 |
| 3,700,357 | A | * | 10/1972 | Williams | 418/239 |
| 4,563,137 | A | * | 1/1986 | Rineer | 418/63 |
| 4,759,679 | A | | 7/1988 | Mûller | 414/416 |
| 5,007,813 | A | * | 4/1991 | Da Costa | 418/63 |
| 5,950,452 | A | * | 9/1999 | Sakitani et al. | 62/498 |
| 6,250,899 | B1 | * | 6/2001 | Lee et al. | 418/63 |

FOREIGN PATENT DOCUMENTS

| | | |
|---|---|---|
| CN | 2084104 | 9/1991 |
| WO | 94/08139 | 4/1994 |

* cited by examiner

*Primary Examiner*—Charles G. Freay
*Assistant Examiner*—Han Lieh Liu
(74) *Attorney, Agent, or Firm*—Banner & Witcoff, Ltd.

(57) ABSTRACT

The invention discloses a rotary piston pump, which comprise a cylinder block, a front end cover and a rear end cover secured to the front and the rear end surfaces of the cylinder block respectively; a cam rotor being fitted in the chamber of the cylinder block, the portion of the rotor having the maximum radius comes into sliding contact with the inner wall of the cylinder block so as to form an axially extending sealing region; a shaft, the rotor is mounted on the shaft and rotatable therewith; a separating means for separating the axially extending sealed chamber, which is formed between the outer surface of rotor and the inner wall of the cylinder block, into an induction chamber and an exhaustion chamber; an inlet and an outlet respectively provided at the two sides of the separating means and communicated with the induction chamber and the exhaustion chamber, the separating means comprises: an axially extending circular arc-shaped recess formed in the inner wall of the cylinder block with its axis being parallel to that of the cylinder block; a cylindrical rod provided in the recess, in the assembled state of the separating means, a axially extending circular gap is formed between the outer surface of the rod and the circular arc surface of the recess ; a separating member provided in the gap and being capable of sliding circumferentially therein for separating the sealed chamber into the induction chamber and the exhaustion chamber; biasing means for biasing the separating member towards the cam rotor.

6 Claims, 2 Drawing Sheets

ROTARY PISTON PUMP

FIELD OF THE INVENTION

The invention relates to an energy conversion device which converts mechanical energy into pressure energy, and particularly to a rotary piston pump.

BACKGROUND OF THE INVENTION

The conventional rotary piston pumps have much more advantages than pistons of other type, but they have the following drawbacks it is difficult to manufacture them, and it is difficult to achieve reliable sealing, and the sealing effect drops deeply especially when they operate under high pressure. The main reason that results in the above drawbacks lies in that the reliability of the separating plate, which separate the high pressure chamber from the low pressure chamber, is poor, and in order to improve the sealing effect, a much more complicated manufacturing process is required.

SUMMARY OF THE INVENTION

The object of the invention is to provide a rotary piston pump in which a reliable sealing can be achieved between the high pressure chamber and the low pressure chamber.

To achieve the above object, there is provided a rotary piston pump comprising a cylinder block; a front end cover and a rear end cover fixed to the front end surface and the rear end surface of the cylinder block respectively; a cam rotor fitted in the inner chamber of the cylinder block, the portion of the cam rotor with a maximum radius coming into sliding contact with the inner wall of the cylinder block so as to form an axially extending sealing region; a shaft, the cam rotor being mounted on the shaft and being rotatable therewith; separating means for separating the axially extending sealed chamber, which is formed between the circumferential surface of the cam rotor and the inner surface of the cylinder block, into an induction chamber and an exhaustion chamber; an inlet and an outlet provided on the two sides of the separating means and communicated with the induction chamber and the exhaustion chamber respectively, wherein the separating means comprising:

- an axially extending circular arc-shaped recess formed in the inner wall of the cylinder block, the central axis of the recess being parallel to the axis of the inner chamber of the cylinder block;
- a cylinder provided in the recess, in an assembled state of the separating means, the cylinder being substantially co-axial with the circular arc-shaped recess and an axially extending circular gap being formed between its circumference and the circular surface of the recess;
- a separating member fitted into the circular gap, the separating member being movable circumferentially in the circular gap;
- biasing means for biasing the separating member towards the cam rotor.

According to one aspect of the invention, the separating member comprises two arc separating blocks which are fitted into the circular gap and located on the two sides of the cylinder in the circumferential direction, the ends of the separating blocks facing the inner chamber of the cylinder block abut against the cam rotor, and a sliding and sealing contact is achieved therebetween, the biasing means is disposed between the ends of the separating blocks opposite to the inner chamber of the cylinder block.

According to another aspect of the invention, the separating member comprises two sets of arc separating blocks which are fitted into the circular gap and located on the two sides of the cylinder in the circumferential direction, each set of arc separating blocks includes a plurality of arc separating blocks which are superposed one on another in the radial direction, the ends of the separating blocks facing the inner chamber of the cylinder block abut against the cam rotor, and a sliding and sealing contact is achieved therebetween, the biasing means is disposed between the ends of the two sets of arc separating blocks opposite to the inner chamber of the cylinder block.

According to yet another aspect of the invention, the cylinder is a free cylinder which can rotate about its own axis and can move radially and axially.

The rotary piston pump of the invention may comprises a single cylinder or a plurality of cylinders. In the case of plurality of cylinders, the cylinders are arranged in the axial direction, and the phase angle between the rotors in the cylinder blocks is equal to 360°/n, where n is the number of the cylinders.

According to the invention, the arc separating blocks, which are rotatable about a rotation axis under the action of the biasing means, are used as the separating means for separating the induction chamber form the exhaustion chambers, therefore the inventive rotary piston pump is simple is in structure and is easy to manufacture, and can ensure a reliable sealing between the induction chamber and the exhaustion chamber.

BRIEF DESCRIPTION OF THE ACCOMPANYING DRAWINGS

The invention will be described in detail with reference to the accompanying drawings, in which FIG. 1 is a cross-sectional view of the first embodiment of the rotary piston pump in accordance with the invention;

DETAILED DESCRIPTION OF THE PREFERRED EMBODIMENTS

Figure 1:
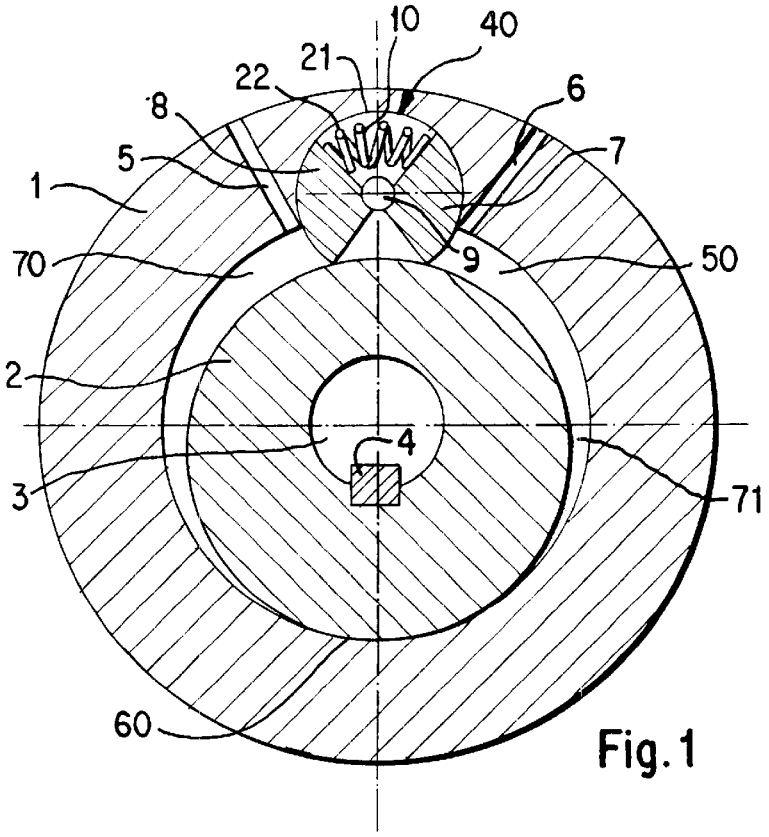
Figure 2:
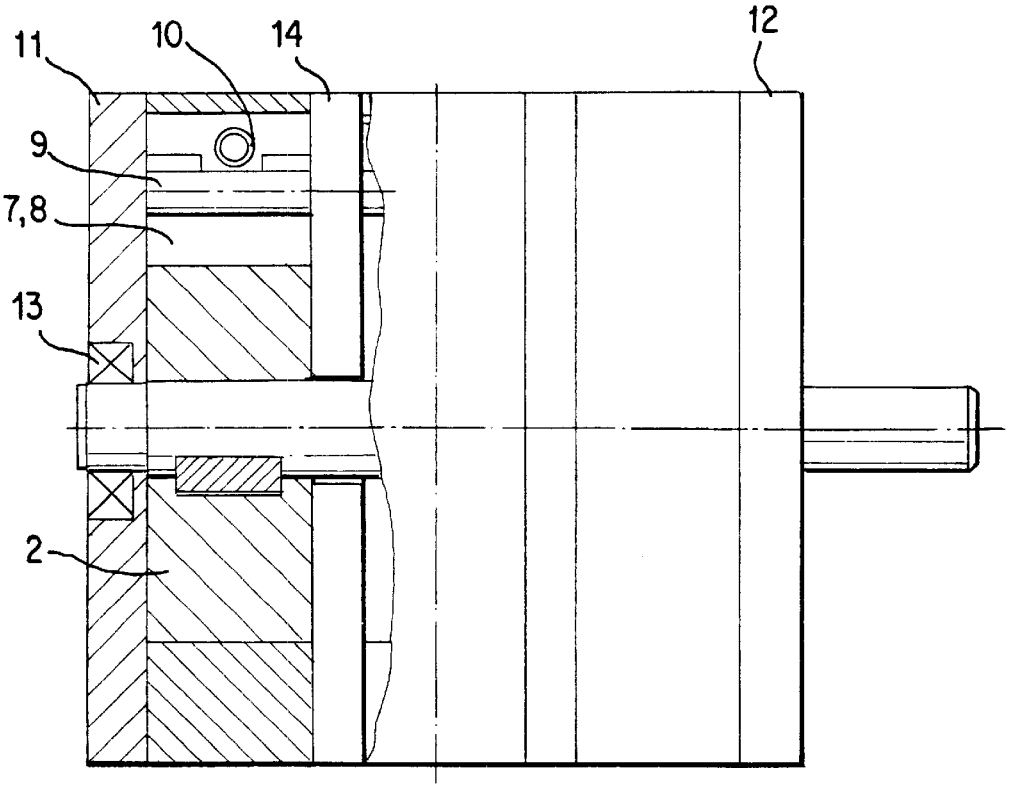
FIG. 2 is a part sectioned longitudinal view of the rotary piston pump shown in FIG. 1

As shown in FIGS. 1 and 2, the rotary piston pump in accordance with the first embodiment of the invention comprises a cylindrical cylinder block 1, in the inner chamber of the cylinder block there is disposed a cam rotor 2, and an axially extending sealed chamber 50 is formed between the outer circumferential surface of the cam rotor and the inner surface of the cylinder block. The cam rotor 2 is mounted on a shaft 3 and is circumferentially positioned by means of a key 4. The shaft 3 is supported by the bearings 13 which are respectively mounted in end covers 11 and 12 and/or an intermediate division plate 14. The rotor 2 has a contact portion 60 the radius of which is substantially equal to the radius of the inner chamber of the cylinder block 1, the clearance formed between the contact portion and the inner surface of the cylinder block is such that it allows the rotor to slide relative to the inner surface of the cylinder block and an axially extending sealing region is formed therebetween.

A separating system, herein after referred to as separating means 40, which separates the sealed chamber 50 into an induction chamber 70 and an exhaustion chamber 71, is provided in the cylinder block 1. The separating means 40 comprises: an axially extending circular arc-shaped recess formed in the inner wall of the cylinder block 1; a free mandrel or cylinder 9 provided in the recess, in an assembled state of the parting means, the free mandrel 9 is substantially co-axial with the circular arc-shaped recess 21 and an axially extending circular gap 22 is formed between the circumference of the mandrel and the circular surface of the recess 21; two arc separating blocks 7 and 8 fitted into the circular gap 22, the diameters of the outer circular arc surface and the inner circular arc surface of the separating blocks correspond to the diameters of the circular arc-shaped recess 21 and the mandrel 9 respectively, with a clearance formed therebetween which allows the separating blocks to slide circumferentially in the circular gap 22. The ends of the separating blocks facing the inner chamber of the cylinder block abuts against the cam rotor 2, and a sliding and sealing contact is achieved therebetween so as to separate the sealed chamber 50 into an induction chamber and an exhaustion chamber. Biasing means 10 is disposed between the ends of the separating blocks opposite to the inner chamber of the cylinder block, the biasing means 10 biases the two separating blocks towards the cam rotor 2 so as to achieve the sliding and sealing contact between the separating blocks and the cam rotor. On the two sides of the separating means 40, there are respectively provided an inlet 5 and an outlet 6 in the wall of the cylinder block which communicate with the induction chamber and the exhaustion chamber respectively.

During the operation of the rotary piston pump, the free mandrel 9 may rotate about its own axis and can move in the radial direction so as to make the separating means work more stably and reliably.

The operation of the rotary piston pump in accordance with the embodiment of the invention is now described in connection with the drawings.

As shown in FIG. 1, when the rotor 2, which is driven by the shaft 3, rotates counterclockwise in the direction indicated by the arrow, the volume of the induction chamber increases, and therefore a negative pressure is established in the induction chamber. As a result, gas or liquid flows into the cylinder block via the inlet which communicates with the induction chamber; at the same time, the gas or liquid in the exhaustion chamber is compressed as the contact portion 60 rotates counterclockwise, and is discharged via the outlet which communicates with the exhaustion chamber. Under the action of the biasing means, the separating blocks are in good contact with the cam rotor. Therefore, a good sealing is achieved between the induction chamber and the exhaustion chamber to allow for the above-mentioned operation. The above process is repeated continuously as the cam rotor rotates.

Figure 3:
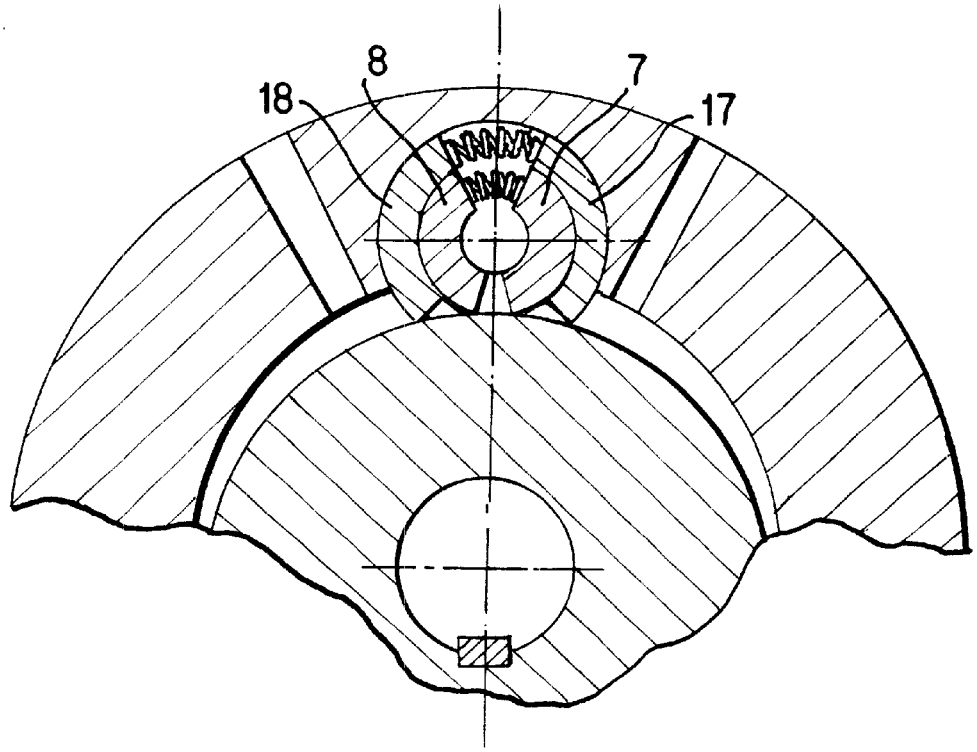
FIG. 3 is a cross-sectional view of the second embodiment of the rotary piston pump in accordance with the invention.

FIG. 3 shows the rotary piston pump of the second embodiment in accordance with the invention. In the embodiment, two sets of arc separating blocks 7, 8 and 17, 18 are provided, the second set of arc separating blocks 17, 18 are disposed between the first set of arc separating blocks and the inner surface of the circular arc-shaped recess. Like the first set of arc separating blocks 7, 8, the ends of the second set of arc separating blocks facing the inner chamber of the cylinder block make contact with the cam rotor, and biasing means is disposed between the ends opposite to the inner chamber of the cylinder block for biasing the second set of separating blocks towards the cam rotor. The structural features of the second embodiment, which are similar to those of the first embodiment, are not described here for clarity.

Although the invention has been described in connection with the embodiments, those skilled in the art will appreciate that the embodiments are exemplary but not limitative, various modifications are possible without departing from the spirit and scope of the invention. For example, the free mandrel may be fixed radially relative to the cylinder block, and in this case, a single arc separating block may be provided instead of a set of arc separating blocks which are disposed symmetrically; the circular gap formed between the free mandrel and the circular arc-shaped recess may be replaced with a circular hole formed in the cylinder block; furthermore, the circular hole may be composed of two circular holes which are separated circumferentially.

What is claimed is:

1. A rotary piston pump, comprising a cylinder block, a front end cover and a rear end cover fixed to a front end surface and a rear end surface of the cylinder block respectively; a cam rotor fitted in an inner chamber of the cylinder block, the cam rotor having a portion which comes into sliding contact with an inner wall of the cylinder block so as to form an axially extending sealing region; a shaft, said cam rotor being mounted on the shaft and being rotatable therewith; a separating system, which is formed between the circumferential surface of the cam rotor and the inner surface of the cylinder block, for separating an axially extending sealed chamber into an induction chamber and an exhaustion chamber; an inlet and an outlet provided on the two sides of the separating system and communicated with the induction chamber and the exhaustion chamber respectively, wherein said separating system comprises:

an axially extending circular arc-shaped recess formed in the inner wall of said cylinder block, a central axis of the recess being parallel to an axis of the inner chamber of said cylinder block;

a cylinder provided in the recess, said cylinder being a free cylinder, in an assembled state of the separating system, the cylinder being substantially co-axial with the circular arc-shaped recess and an axially extending circular gap being formed between a circumference of the cylinder and the circular surface of the recess;

a separating member fitted into said circular gap, said separating member being movable circumferentially independently of said cylinder and being movable circumferentially in the circular gap; and biasing means for biasing the separating member towards the cam rotor.

2. The rotary piston pump of claim 1, wherein said separating member comprises two arc separating blocks which are fitted into said circular gap and located on the two sides of said cylinder in the circumferential direction, ends of the separating blocks facing the inner chamber of the cylinder block abut against the cam rotor, and a sliding and sealing contact is achieved therebetween, said biasing means is disposed between the ends of the separating blocks opposite to the inner chamber of the cylinder block.

3. The rotary piston pump of claim 1, wherein said separating member comprises two sets of arc separating blocks which are fitted into said circular gap and located on the two sides of said cylinder in the circumferential direction, each set of arc separating blocks includes a plurality of arc separating blocks which are superposed one on another in the radial direction, ends of the separating blocks facing the inner chamber of the cylinder block abut against the cam rotor, and a sliding and sealing contact is achieved therebetween, said biasing means is disposed between the ends of the two sets of arc separating blocks opposite to the inner chamber of the cylinder block.

4. The rotary piston pump of claim 1, wherein said cylinder can rotate about its own axis and can move radially and axially.

5. The rotary piston pump of claim 1 including a plurality of cylinders arranged in the axial direction.

6. The rotary piston pump of claim 5, wherein the phase angle between the rotors in the cylinder blocks is equal to 360°/n, where n is the number of the cylinders.

* * * * *